US010507894B2

(12) United States Patent
Prasad et al.

(10) Patent No.: US 10,507,894 B2
(45) Date of Patent: Dec. 17, 2019

(54) SELF-RESTORING MOTION COMPENSATING MOORING SYSTEM

(71) Applicants: Jitendra Prasad, Houston, TX (US); William C Hu, Katy, TX (US); Manoj Menon, Katy, TX (US)

(72) Inventors: Jitendra Prasad, Houston, TX (US); William C Hu, Katy, TX (US); Manoj Menon, Katy, TX (US); Ramakrishnan Hari Prasad, Katy, TX (US); Suresh Kumar Moyyeti, Katy, TX (US)

(73) Assignees: Jitendra Prasad, Houston, TX (US); William C. Hugh, Katy, TX (US); Manoj Menon, Katy, TX (US)

( * ) Notice: Subject to any disclaimer, the term of this patent is extended or adjusted under 35 U.S.C. 154(b) by 0 days.

(21) Appl. No.: 16/381,122

(22) Filed: Apr. 11, 2019

(65) Prior Publication Data

US 2019/0315438 A1 Oct. 17, 2019

Related U.S. Application Data

(60) Provisional application No. 62/655,955, filed on Apr. 11, 2018.

(51) Int. Cl.

| | |
|---|---|
| ***B63B 39/06*** | (2006.01) |
| ***B63B 21/20*** | (2006.01) |
| *B63B 21/16* | (2006.01) |
| *B63B 21/50* | (2006.01) |

(52) U.S. Cl.

CPC ..... *B63B 39/06* (2013.01); *B63B 21/20* (2013.01); *B63B 21/16* (2013.01); *B63B 21/50* (2013.01); *B63B 2021/206* (2013.01)

(58) Field of Classification Search

CPC ..... B63B 35/44; B63B 39/09; B63B 21/04; B63B 39/02; B63B 21/20; B63B 2039/067; F03B 13/20

See application file for complete search history.

(56) References Cited

U.S. PATENT DOCUMENTS

| | | | | |
|---|---|---|---|---|
| 3,708,991 A * | 1/1973 | Barkley | B63B 35/44 405/194 |
| 4,823,719 A * | 4/1989 | Sarwe | B63B 39/06 114/126 |
| 4,938,630 A * | 7/1990 | Karsan | B63B 21/50 114/264 |
| 2011/0067617 A1* | 3/2011 | Denjean | B63B 27/24 114/264 |
| 2019/0077488 A1* | 3/2019 | Vandenworm | B63B 21/50 |

* cited by examiner

*Primary Examiner* — Andrew Polay

(74) *Attorney, Agent, or Firm* — Hill Wallack LLP; Jason L DeFrancesco

(57) ABSTRACT

There is provided a self-restoring motion compensating mooring system for a floating unit. The mooring system includes a plurality of mooring anchors, a plurality of top fairleads attached near the top edges of the floating unit, a plurality of bottom fairleads attached near bottom edges of the floating unit, a stabilizer, a plurality of mooring cables passing through the respective top and bottom fairleads, connected between the plurality of mooring anchors and the stabilizer. Further, in respective equilibrium positions of the floating unit and the stabilizer, the center of gravity of the stabilizer is located directly below the center of gravity of the floating unit.

9 Claims, 3 Drawing Sheets

SELF-RESTORING MOTION COMPENSATING MOORING SYSTEM

FIELD OF THE INVENTION

The present invention generally relates to station keeping, stability and motion control of floating units. More specifically the present invention relates to a self-restoring motion compensating mooring system that offers simplicity in design and relatively lower capital and operational expenditures.

DESCRIPTION OF THE RELATED ART

For any floating offshore unit, which includes but is not limited to be a structure, platform, vessel or rig that is deployed in water of any depth, the factors that play a vital role in its successful functional operation are station keeping, stability and motion control. Conventional approach to meeting such objectives is deployment of mooring systems. However, the mooring systems of the present state of the art suffer from significant trade-off between cost and performance. Those system that offer higher performance tend to be complex in design, construction, installation and operation and resultant higher operational and capital expenditures.

Therefore, there is a need in the art for a self-restoring motion compensating mooring system that will overcome or substantially ameliorate at least some of the deficiencies of the prior art, or at least provide an alternative.

SUMMARY OF THE INVENTION

It is therefore an object of the present invention to provide a mooring system that offers convenient and economical design, installation and operation.

The present invention meets the object by providing a self-restoring motion compensating mooring system for a floating unit, the mooring system includes a floating unit, a plurality of mooring anchors, a plurality of top fairleads attached near the top edges of the floating unit, a plurality of bottom fairleads attached near bottom edges of the floating unit, a stabilizer located below the floating unit configured to lower the center of gravity of the entire system leading to greater stability, a plurality of mooring cables passing through the respective top fairleads and bottom fairleads, connected between the plurality of mooring anchors and the stabilizer. Further, the center of gravity of the stabilizer is located directly below the center of gravity of the floating unit in the respective equilibrium positions of the floating unit and the stabilizer. Furthermore, external forces acting upon the floating unit and/or stabilizer, causes the stabilizer to move in the direction of the applied force relative to the position of the stabilizer under the floating unit thereby creating tension on the plurality of mooring cables. Additionally, the tension created by the displacement of the stabilizer acts in the opposite direction to offset the applied force and brings the floating unit and the stabilizer back to the respective neutral equilibrium positions.

In certain embodiments, the floating unit is selected from a structure, platform, vessel or rig that is deployed in water of any depth.

In certain embodiments, the external forces include forces applied by the wind, current, waves and/or tides.

In certain embodiments of the invention, each of the plurality of mooring cables passes through two or more top fairleads and/or bottom fairleads of the plurality of top fairleads and the plurality of bottom fairleads, for motion compensation or for avoiding interference by a structure of the floating unit.

In one embodiment of the invention, the plurality of top fairleads and the plurality of bottom fairleads are mounted on a plurality of hinges and/or pivots to allow the fairleads to swing side to side and/or to rotate In certain embodiments of the invention, the plurality of mooring lines pass through respective tension sensors to provide signals to curtail, to suspend or to shutdown floating unit operation in case of abnormally high or low cable tension.

In certain embodiments of the invention, the plurality of mooring cables are connected with a plurality of respective wear cables, thereby, making the plurality of wear cables connect with the stabilizer, through the plurality of fairleads attached on to the floating unit.

In certain embodiments of the invention, the plurality of top fairleads are selected from a group comprising winches, pulleys and a combination thereof In certain embodiments of the invention, the combination of winches and pulleys may be wound manually or with a motor driven by electric, hydraulics or pneumatic power.

These and other objects, features and advantages of the present invention will become apparent from a review of the following drawings and detailed description of the preferred embodiments of the invention.

BRIEF DESCRIPTION OF THE DRAWINGS

The present invention can best be understood in connection with the accompanying drawings. It is noted that the invention is not limited to the precise embodiments shown in the drawings, in which.

DETAILED DESCRIPTION OF THE INVENTION

Figure 1:
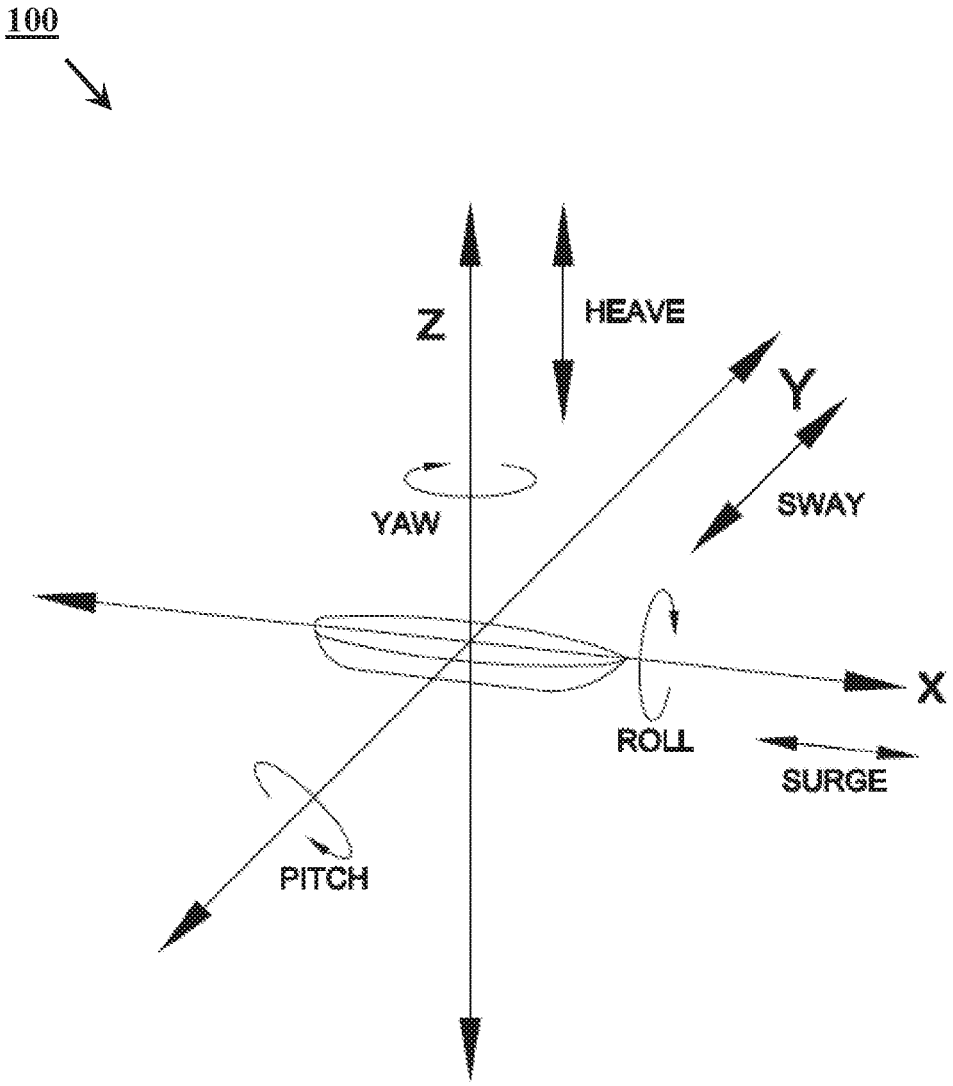
FIG. 1 illustrates a plurality of types (degrees) of motions possible for a floating unit.

For purposes of promoting and understanding of the principles of the invention, reference will now be made to the embodiments illustrated in the drawings and specific language will be used to describe the same. It will nevertheless be understood that no limitation of the scope of the invention is thereby intended. The invention includes any alterations and further modifications in the illustrated devices and described methods and further applications of the principles of the invention that would normally occur to one skilled in the art to which the invention relates.

Applied dynamic motions on floating units are important design considerations. Dynamic motions introduce additional loads, stress and fatigue on the structure of a floating unit. And, above a certain amplitude, dynamic motions can cause negative health, safety and/or environmental impacts or cause equipment damage if operation continues. Externally induced dynamic motion from wind, current and waves impact the stability and station keeping ability of the floating unit. With the Self-Restoring Motion Compensating Mooring System, when external forces displace the floating unit away from its original position, a stabilizer located below the floating unit dampens the motion and restores the floating unit to its original position. Additionally, since the stabilizer is located below the floating unit, the stabilizer lowers the center of gravity of the entire system leading to greater stability.

When the floating unit is in its equilibrium position, the tension on each mooring cable is the same as the tension on the other cables. And, the stabilizer is at its equilibrium position under the floating unit. Application of an external force displaces the floating unit, the stabilizer is displaced from its equilibrium position. This changes the tension on each of the mooring cable. The increased tension creates a net restoring force to counter the external force and will tend to return both the floating unit and the stabilizer to its respective equilibrium position when the applied external force is reduced. Stabilizer motion is tuned to stay out of phase from the floating unit.

Besides creating restoring forces, the mass of the stabilizer creates inertia to dampen the motion induced by an externally applied force.

For the purpose of this specification, a circular shaped floating unit is considered. But, the mooring system can be installed on floating units of any shape or size without departing from the scope of the present invention.

Figure 2:
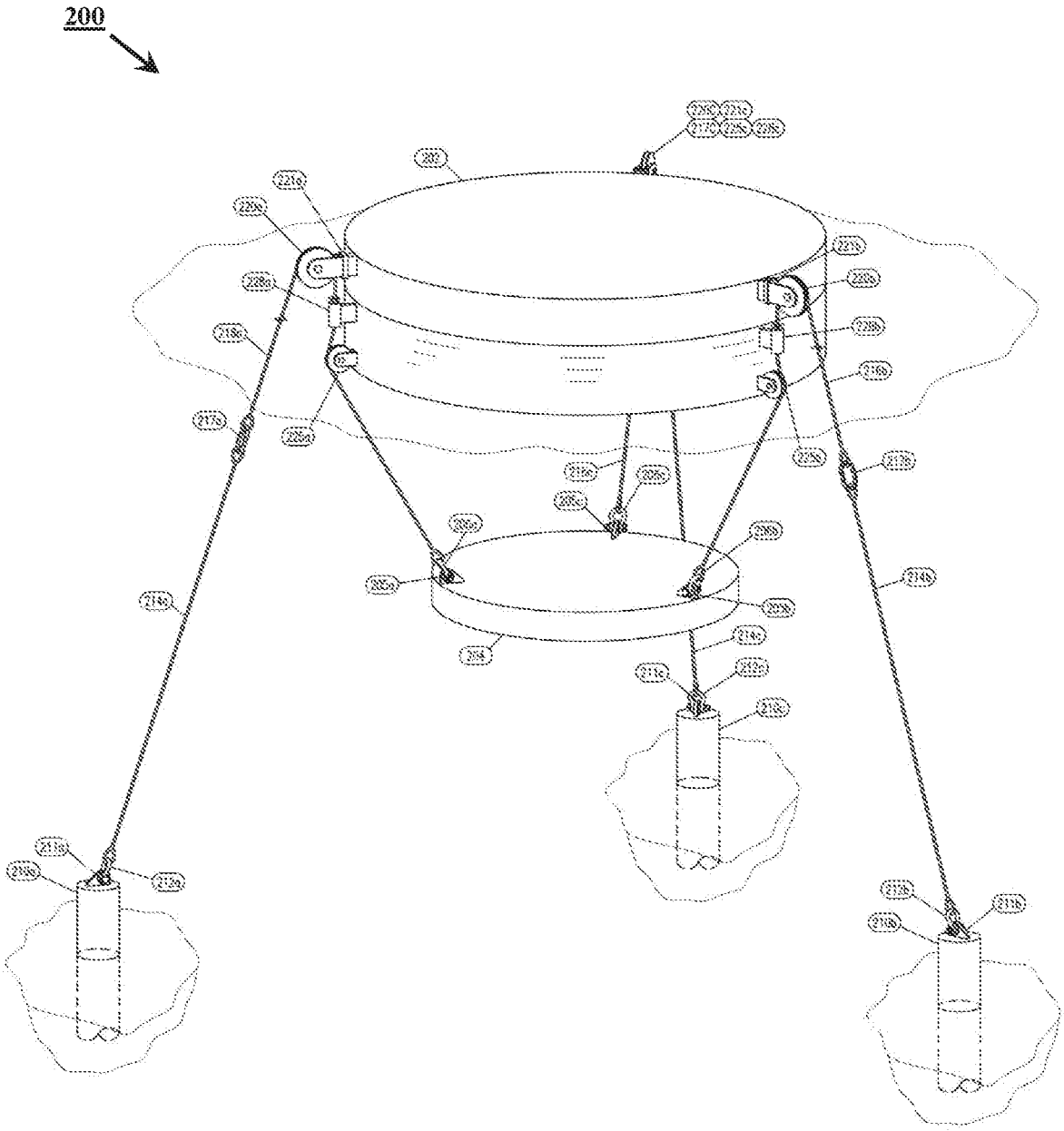
FIG. 2 illustrates a mooring system for a floating unit, in accordance with an embodiment of the present invention.

FIG. 1 illustrates a plurality of types/degrees of motions/freedom 100 possible for a floating unit. Natural forces such as waves, current, or wind can cause a floating unit to move in one or more of six degrees of freedom (three translational degrees of freedom and three rotational degrees of freedom) which are shown in FIG. 1—along and about X, Y, and Z axes. The three translational motions include surge (along X axis), sway (along Y axis) and heave (along Z axis). Further, the three rotational motions include roll (about X axis), pitch (about Y axis) and yaw (about Z axis). Such induced dynamic motions can cause compressive or tension forces on the structure of the floating unit and affects proper operation of the floating unit. And, forces of certain amplitude or frequency beyond a certain limit may cause stress or fatigue failure in the structure of the floating unit. Hence, it is important to minimize the induced dynamic motions FIG. 2 illustrates a mooring system 200 for a floating unit 202, in accordance with an embodiment of the present invention. The floating unit 202 may be, but is not limited to, a structure, platform, vessel or rig that is required to deployed in water of any depth. The factors that play a vital role in its successful functional operation are station keeping, stability and motion control. For the keeping the floating unit stationary in a water body, there are provided, at the base of the mooring system 200, a plurality of mooring anchors 210 (for example 210*a*, 210*b* and 210*c* etc.). In various embodiments, there may be at least three mooring anchors 210. The plurality of mooring anchors 210 may be made of metal, metal alloy or other material (which may contain reinforcement or tensioners). The plurality of mooring anchors 210 may be coated or covered to prevent corrosion, erosion or for other structural or operational purposes. Dimensions, shape, weight, and material of the plurality of mooring anchors 210 may vary in accordance with the requirement of the installation site and application.

In one embodiment of this invention, the plurality of mooring anchors 210 may be suction piles or piles that are driven into a sea floor. In another embodiment of this invention, the mooring anchors 210 may be large concrete blocks or vertically loaded anchors that sit on the sea floor.

A mooring anchor pad eye (for example 211*a*) of the plurality of mooring anchor pad eyes 211 (for example 211*a*, 211*b* and 211*c*, etc.) is securely attached to the respective mooring anchor (for example 210*a*) of the plurality of mooring anchors. The mooring anchor pad eye (for example 211*a*) is to facilitate connection between the mooring anchor (for example 210*a*) with the respective mooring cable (for example 214*a*) via the mooring anchor connector (for example 212*a*). The plurality of mooring anchor pad eyes 211 is made of metal, metal alloy and/or other material that may be coated or covered to prevent corrosion, erosion or abrasion. The thickness and/or material of the coating and/or covering on the mooring anchor pad eye 211 may vary depending on location and amount of wear.

A mooring anchor connector (for example 212*a*) of a plurality of mooring anchor connectors 212 (for example 212*a*, 212*b* and 212*c* etc.) should securely connect a mooring cable (for example 214*a*) to the respective mooring anchor pad eye (for example 211*a*) unless deliberately activated to disconnect. When deliberately activated to disconnect, the mooring anchor connector 212*a* should allow the mooring cable 214*a* to disconnect from the respective mooring anchor pad eye 211*a*. The plurality of mooring anchor connectors 212 may be constructed of metal, metal alloy or durable plastic with or without reinforcements. Also, the plurality of mooring anchor connectors 212 may be coated or covered to prevent corrosion and/or wear. The thickness and/or material of the coating and/or covering on the mooring anchor connectors 212 may vary depending on location and amount of wear.

Further, the mooring system 200 includes a plurality of mooring cables 214 (for example 214*a*, 214*b* and 214*c* etc.) connected between the plurality of mooring anchors 210 and a stabilizer 204 via plurality of mooring anchor pad eyes 211 (for example 211*a*, 211*b* and 211 *c* etc.), mooring anchor connectors 212 (for examples 212*a*, 212*b* and 212*c* etc.). At the floating unit 202, the plurality of mooring cables 214 pass through a plurality of top fairleads 220 (for example 220*a*, 220 and 220*c* etc.), bottom fairleads 225 (for example 225*a*, 225*b* and 225*c* etc.) that are attached to the floating unit 202. The plurality of mooring cables 214 connected to the stabilizer 204 by a plurality of stabilizer connectors 206 (for example 206*a*, 206*b* and 206*c* etc.) with a plurality of stabilizer pad eyes 205 (for example 205*a*, 205*b* and 205*c* etc.) that are securely attached to the stabilizer 204.

The plurality of mooring cables 214 may be made of natural or artificial material (including but not is not limited to metal, metal alloy, plastic, and composite) and in single fiber or braided multiple fibers. Also, the plurality of mooring cables 214 may be coated, sleeved or covered to prevent corrosion or abrasion.

In certain alternate embodiments of this invention, the plurality of mooring cables 214 are connected with a plurality of respective wear cables 216 (for example 216*a*, 216*b* and 216*c* etc.) by a plurality of respective wear cable connectors 217 (for example 217*a*, 217*b* and 216*c* etc.). Therefore, the plurality of wear cables 216 are connected with the stabilizer 204, through the plurality of top fairleads 220 and the plurality of bottom fairleads 225 that are attached to the floating unit 202. Then, the plurality of wear cables 216 are connected to the stabilizer 204 by a plurality of stabilizer connectors 206 with a plurality of stabilizer pad eyes 205 that are securely attached to the stabilizer 204.

The plurality of wear cables 216 may be constructed of natural or artificial material (including but not is not limited to metal, metal alloy, plastic, and composite) and in single fiber or braided multiple fibers. Also, the plurality of wear cables 216 may be coated or cabled to prevent corrosion or abrasion. The plurality of wear cables 216 are intended for easy replacement because of the contact, tension and wear against the plurality of top fairleads 220 and the plurality of bottom fairleads 225. As such, the wear cables 216 may have additional thickness or strength of coating or cover as compared with the mooring cables 214.

A wear cable connector (for example 217*a*) of the plurality of wear cable connectors 217 (for example 217*a*, 217*b* and 217*c* etc.) should securely connect a wear cable (for example 216*a*) to the respective mooring cable (for example 214*a*) unless deliberately activated to disconnect. When deliberately activated to disconnect, the mooring cable connector 217*a* should allow the mooring cable 214*a* to disconnect from the wear cable 216*a*. The plurality of wear cable connectors 217 may be constructed of metal, metal alloy or durable plastic with or without reinforcements. Also, the plurality of wear cable connectors 217 may be coated or covered. The thickness and/or material of the coating and/or covering on the wear cable connector 217 may vary depending on location and amount of wear.

A stabilizer connector (for example 206*a*) of a plurality of stabilizer connectors 206 (for example 206*a*, 206*b* and 206*c* etc.) should securely connect a wear cable (for example 216*a*) or a mooring cable (for example 214*a*) to the respective stabilizer pad eye (for example 205*a*) unless deliberately activated to disconnect. When deliberately activated to disconnect, the stabilizer connector 206*a* should allow the wear cable 216*a* or the mooring cable 214*a* to disconnect from the stabilizer pad eye 205*a*. The plurality of stabilizer connectors 206 may be constructed of metal, metal alloy or durable plastic with or without reinforcements. Also, the plurality of stabilizer connectors 206 may be coated or covered. The thickness and/or material of the coating and/or covering on the wear cable connector 206 may vary depending on location and amount of wear.

A stabilizer pad eye (for example 205*a*) of the plurality of stabilizer pad eyes 205 (for example 205*a*, 205*b* and 205*c*, etc.) is securely attached to the stabilizer 204. The stabilizer pad eye (for example 205) is to facilitate connection between the stabilizer 204 with the respective wear cable (for example 216*a*) or mooring cable (for example 214*a*) via the stabilizer connector (for example 206*a*). The location of the stabilizer pad eyes 205 on the stabilizer 204 will vary depending on site conditions, application and performance requirements. The plurality of stabilizer pad eyes 205 is made of metal, metal alloy and/or other material that may be coated or covered to prevent corrosion, erosion or abrasion. The thickness and/or material of the coating and/or covering on the mooring anchor pad eye 205 may vary depending on location and amount of wear.

The mooring system 200 includes a plurality of top fairleads 220 (for example 220*a*, 220*b* and 220*c* etc.) and a plurality of bottom fairleads 225 (for example 225*a*, 225*b* and 225*c* etc.). The plurality of top fairleads 220 and the plurality of bottom fairleads 220 are attached to the floating unit 202. Locations for attachment of the plurality of top fairleads 220 and the plurality of bottom fairleads 225 depend on shape, dimensions and weight of the floating unit 202 as well as other design criterion. In certain embodiments of this invention, the number of sets of fairleads may vary depending on application such that the top fairleads are not required or additional sets of fairleads may be added.

In certain embodiment of this invention, the plurality of top fairleads 220 are connected to plurality of top fairlead hinges 221 (for example 221*a*, 221*b*, 221*c*) to permit the plurality of top fairleads to yaw side to side as the floating unit 202 is displaced laterally from the neutral position.

The plurality of top fairleads 220, the plurality of top fairlead hinges 221 and the plurality of bottom fairleads 225 may be made of metal, metal alloy and/or other material and may be coated to prevent corrosion and/or wear.

In certain embodiment of this invention, the plurality of top fairlead hinges 221 may contain bearings (sealed or not) and/or other devices to reduce friction In one embodiment of this invention, the bottom fairleads 225 may be mounted on hinges and/or pivots to allow the bottom fairlead to swing side to side and/or to rotate. The hinges/pivots made be made of metal, metal alloy and/or other material and may be coated to prevent corrosion. The hinges/pivots may also contain bearings (sealed or not) and/or devices to reduce friction.

In certain embodiments of this invention, the plurality of top fairleads 220 may be plurality of combination winches/pulleys similar but is not limited to Capstan Winch. The combination winches/pulleys may be wound manually, or with an electrical, hydraulic, or pneumatic motor. The combination winches/pulleys permit easier and quicker installation by taking up the slack in the mooring line while maintaining the stabilizer's 204 relative position to the floating unit 202

In certain embodiments of this invention, plurality of mooring cables 214 or wear cables 216 pass through plurality of cable tension sensors 228 (for example 228*a*, 228*b*, 228*c*) that will provide signals to curtail, to suspend or to shutdown operation on the floating unit 202 if cable tension is abnormally high or low. The mounting locations and methods of the plurality of cable tension sensors will vary depend on the application and the dimension and shape of the floating unit 202. The tension sensors may be located in one or multiple sets of location whether built in as a part of a fairlead/pulley or combination winch/pulley or installed separately.

The mooring system 200 includes a stabilizer 204. In the context of this specification, a "stabilizer" is an object of a predetermined mass, density and dimension that has been adapted to be submerged in water at a predetermined depth. It is envisaged here, that the principles of self-restoring and motion compensation of this invention is based on the respective equilibrium positions and the center of gravity of the floating unit 202 and the stabilizer 204, the center of gravity of the stabilizer 204. This can be explained from the following figure.

Figure 3:
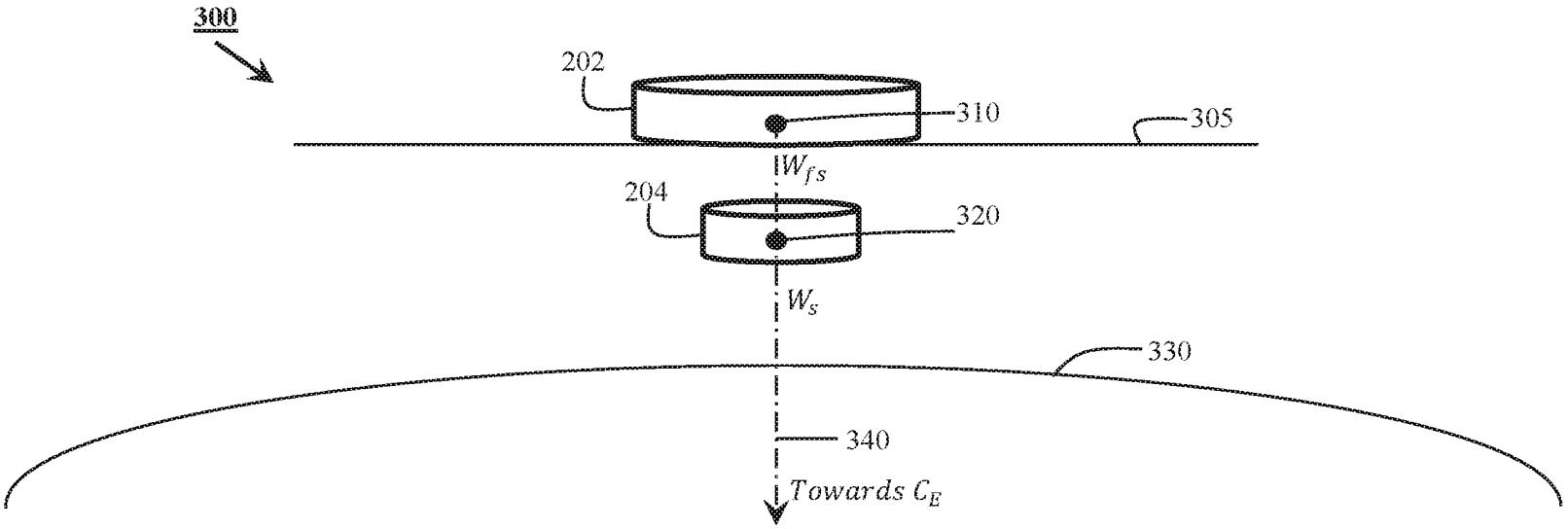
FIG. 3 illustrates the floating unit and a stabilizer in the respective equilibrium positions, in accordance with an embodiment of the present invention.

FIG. 3 illustrates that in a calm sea surface, the floating unit 202 and the stabilizer 204 are in the respective equilibrium positions. In this state, the center of gravity of the stabilizer 204 is directly under the center of gravity of the floating unit 202. The center of gravity of the floating unit 202 is represented by a numeral 310 and the center of gravity of the stabilizer is represented by a numeral 320. Sea floor is represented by numeral 330. FIG. 3 also illustrates an axis 340 along which gravity or weight ($W_{fs}$) of the floating unit 202 acts on the center of gravity 310 of the floating unit 202. It is envisaged that gravity or weight ($W_s$) of the stabilizer 206 acts along the same axis 340 during equilibrium condition. In this state, tension on each mooring cable 214 (which may or may not include the wear cable 216) is about the same as tension in the others.

When an external force such as wave, wind or current displaces the floating unit 202 from the equilibrium position, the stabilizer 204 is also moved away from the equilibrium position and the position relative to the floating unit 202. This causes tension to increase on those mooring cables 210 close to the applied external force while tension on the cables away from the applied force decreases. The change in the mooring cables' 214 tension creates restoring forces to bring the floating unit 202 back to the equilibrium position when the applied force is removed.

Changes in the external force cause motion to the floating unit 202 and the stabilizer 204. And, the motion (or changes in relative positions) of the floating unit 202 and the stabilizer 206 causes tension and the restoring forces in the mooring cables 214 to change. The restoring force is maximized when the motions of the floating unit's 202 center of gravity 310 and the motion of the stabilizer's 204 center of gravity 320 are out of phase. Hence, the system 200 is designed, constructed and tuned so the relative motions of the floating unit 202 and the stabilizer 206 are always out of phase so the restoring forces will reduce motion of the floating unit 202 and to return it to the stable and equilibrium state.

Additionally, with center of gravity 320 of the stabilizer 204 located below the center of gravity 310 of floating unit 202, the entire system's 200 center of gravity is lowered. This improves stability of the entire system in less than calm water conditions.

The stabilizer 204 may be made of any material or combination of materials (which may or may not contain reinforcement or pre-stress tensioners). And, regardless of material of construction, the stabilizer 204 may be coated and/or covered to prevent corrosion or erosion or for other structural or operational purposes. The stabilizer 204 may be solid or hollow (with or without ballasting capability). For the purpose of this specification, the stabilizer 204 is disk shaped. However, the dimension, weight density and shape of the stabilizer 204 may vary with application and design criterion without departing from the scope of the present invention. In certain embodiments of this invention, the stabilizer 204 and may have an opening to allow objects (including but not limited to pipe, cables, and wires) to pass through. In other embodiments of this invention, the stabilizer may be able to change shape and/or dimension during operation to suit the requirements of the application.

In certain embodiments of this invention, the plurality of top fairleads 220 are replaced by a plurality of combination winches/pulleys (not shown in FIG. 1). The plurality of combination winches/pulleys expedites the installation of the floating unit 202 by quickly taking up slack in the plurality of mooring cables 214 and/or the plurality of wear cables 216, so the stabilizer 204 will be at a correct relative location below the floating unit 202. Once in the operating mode, the plurality of combination winches/pulleys will be unlocked to permit it to behave as a pulley/fairlead. The plurality of combination winches/pulleys may be made of metal or metal alloy. And, the plurality of combination winches/pulleys may be driven by an electrical, hydraulic or pneumatic motor or turned manually.

Once installed and in operation, gravity pulls on the stabilizer 204 to provide tension to the plurality of mooring cables 214 and/or the plurality of wear cables 216. This sets the floating unit 202 and the stabilizer 204 to a neutral equilibrium position in calm water with minimal or no applied forces acting upon the floating unit 202 or the stabilizer 204. The plurality of top fairleads 220 (or the plurality of combination winches/pulleys) and the plurality of bottom fairleads 225 allow movement of the plurality of mooring cables 214 and/or the plurality of wear cables 216 and the stabilizer 206 relative to the respective equilibrium positions. When a force acts upon the floating unit 202 to induce motion from the equilibrium location of the floating unit 202, the movement causes the stabilizer 204 to move in the direction of the applied force relative to the position of the stabilizer 204 under the floating unit 202 and be closer to the bottom of the floating unit 202. This creates tension on the plurality of mooring cables 214 and/or the plurality of wear cables 216 closest to the acting force. The tension created by the displacement of the stabilizer 204 acts in the opposite direction to offset the applied force and brings the floating unit 202 and the stabilizer 204 back to the respective neutral equilibrium positions. Farther movement of the stabilizer 204 results in higher tension on a respective mooring cable (and a wear cable) on the side to which external force is applied. The tension forces oppose the applied force and brings the stabilizer 204 and the floating unit 202 back to the equilibrium position.

The present invention offers advantages of being simple in construction and being self-restoring in operation. Further, the fact that the mooring system is predominantly a passive system, it offers additional benefits of relatively lower capital and operational expenditures. For the purpose of this specification, only passive component are considered. But, active control components can be added to the mooring system without departing from the scope of the present invention.

This detailed description, and particularly the specific details of the exemplary embodiment disclosed, is given primarily for clearness of understanding and no unnecessary limitations are to be understood therefrom, for modifications will become evident to those skilled in the art upon reading this disclosure and may be made without departing from the spirit or scope of the claimed invention.

The invention claimed is:

1. A self-restoring motion compensating mooring system for a floating unit, the mooring system comprising:

a floating unit;

a plurality of mooring anchors;

a plurality of top fairleads attached near the top edges of the floating unit;

a plurality of bottom fairleads attached near bottom edges of the floating unit;

a stabilizer located below the floating unit configured to lower the center of gravity of the entire system leading to greater stability;

a plurality of mooring cables passing through the respective top fairleads and the respective bottom fairleads, connected between the plurality of mooring anchors and the stabilizer;

wherein the center of gravity of the stabilizer is located directly below the center of gravity of the floating unit in the respective equilibrium positions of the floating unit and the stabilizer;

wherein external forces acting upon the floating unit and/or stabilizer, causes the stabilizer to move in the direction of the applied force relative to the position of the stabilizer under the floating unit thereby creating tension on the plurality of mooring cables;

wherein the tension created by the displacement of the stabilizer acts in the opposite direction to offset the applied force and brings the floating unit and the stabilizer back to the respective neutral equilibrium positions.

2. The mooring system a claimed in claim 1, wherein the floating unit is selected from a structure, platform, vessel or rig that is deployed in water of any depth.

3. The mooring system a claimed in claim 1, wherein the external forces include forces applied by the wind, current, waves and/or tides.

4. The mooring system a claimed in claim 1, wherein each of the plurality of mooring cables passes through two or more top fairleads and/or bottom fairleads of the plurality of top fairleads and the plurality of bottom fairleads, for motion compensation and/or for avoiding interference by a structure of the floating unit.

5. The mooring system a claimed in claim 1, wherein the plurality of top fairleads and the plurality of bottom fairleads are mounted on a plurality of hinges and/or pivots to allow the plurality of top fairleads and the plurality of bottom fairleads to swing side to side and/or to rotate.

6. The mooring system a claimed in claim 1, wherein the plurality of mooring lines pass through respective tension sensors to provide signals to curtail, to suspend or to shutdown floating unit operation in case of abnormally high or low cable tension.

7. The mooring system a claimed in claim 1, wherein the plurality of mooring cables are connected with a plurality of respective wear cables, thereby making the plurality of wear cables connect with the stabilizer, through the plurality of fairleads attached on to the floating unit.

8. The mooring system a claimed in claim 1, wherein the plurality of top fairleads are selected from a group comprising winches, pulleys and a combination thereof.

9. The mooring system a claimed in claim 8, wherein the combination of winches and pulleys are wound manually and/or with a motor driven by electric, hydraulic or pneumatic power.

* * * * *